US005742952A

United States Patent [19]

Huang

[11] Patent Number: 5,742,952

[45] Date of Patent: Apr. 28, 1998

[54] FLUSHING SYSTEM FOR A LAVATORY

[76] Inventor: Chang-Shin Huang, No. 331, Section 2, Yung Ping Road, Taichung, Taiwan

[21] Appl. No.: 768,770

[22] Filed: Dec. 13, 1996

[51] Int. Cl.[6] ..... A47K 3/20

[52] U.S. Cl. ..... 4/420.4

[58] Field of Search ..... 4/420.2, 420.4, 4/420.5, 443, 444, 447

[56] References Cited

U.S. PATENT DOCUMENTS 5,551,098 9/1996 Wilk ..... 4/443

FOREIGN PATENT DOCUMENTS 0329498 5/1930 United Kingdom ..... 4/443

*Primary Examiner*—Charles E. Phillips

*Attorney, Agent, or Firm*—Charles E. Baxley, Esq.

[57] ABSTRACT

A flushing system for a lavatory which includes a lavatory bowl and a lavatory seat disposed on the lavatory bowl, the flushing system including a flexible first cistern disposed between the lavatory seat and the lavatory bowl, a second cistern disposed above and in communicating with the first cistern, a block member disposed on the first cistern wherein the block member has an exit defined laterally therein and a tube extending therefrom and, a valve device rotatably connected to the first cistern with an L-shaped path defined therein. The L-shaped path has one section communicating with the first cistern and the other section of the L-shaped path adjustably and selectably communicates with the exit and the tube by rotating the valve device.

3 Claims, 6 Drawing Sheets

FLUSHING SYSTEM FOR A LAVATORY

BACKGROUND OF THE INVENTION

1. Field of the Invention

The present invention relates to a flushing system and more particularly, to an improved flushing system having an annular and flexible first cistern disposed between the lavatory seat and the lavatory bowl.

2. Brief Description of the Prior Art

Generally, a lavatory comprises a lavatory bowl and a flushing system which is connected to and disposed above the lavatory bowl with a valve means disposed therebetween such that the valve is operated to allow water in a cistern of the flushing system to flush into the lavatory bowl. However, in order to set the cistern above the lavatory bowl, the lavatory has to be disposed away from a wall with a distance defined between the wall and the lavatory and is connected to a pipe in the wall by a exhaust pipe connected between the wall and the lavatory bowl such that the cistern having a width the same as the distance between the wall and the lavatory bowl is disposed above the lavatory bowl. This makes the lavatory occupies a large amount of space. Furthermore, the cistern generally has about 10 liters of water therein so that there will be 10 liters of water flushed into the lavatory bowl in one flush. This is deemed to waste too much water during one flush. Another necessary equipment is a bidet, especially in France, which provides a convenient way to clean bottom of a person after he/she has used the lavatory. The bidet is generally disposed separately from the lavatory bowl.

The present invention intends to provide an improved flushing system which is disposed to the lavatory bowl and includes an annular and flexible first cistern disposed between the lavatory bowl and the lavatory seat, a tube connected to the annular cistern and a second cistern connected to the annular cistern by a valve means so as to mitigate and/or obviate the above-mentioned problems.

SUMMARY OF THE INVENTION

In one aspect of the present invention, there is provided a flushing system for a lavatory which comprises a lavatory bowl with a lavatory seat disposed thereto, the flushing system comprising a first cistern which is a flexible and annular member and is disposed between the lavatory seat and the lavatory bowl.

A block member is disposed in communication with the first cistern and has an exit defined laterally therein and a tube extending therefrom. A valve means is rotatably connected to the first cistern and has an L-shaped path including a first section and a second section defined therein such that the valve means is rotated by operating a crank extending from the valve means. The first section of the L-shaped path communicates with the first cistern and the second section of the L-shaped path adjustably communicates with the tube and the exit by rotating the valve means.

A second cistern is disposed above and in communication with the first cistern.

It is an object of the present invention to provide a flushing system comprising a tube so as to clean the bottom of a user and an exit so as to flush the lavatory bowl by operating a valve means.

It is another object of the present invention to provide a flushing system wherein water in the first cistern is pressed to eject from the tube by a weight of the user sat on a lavatory seat of the lavatory.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
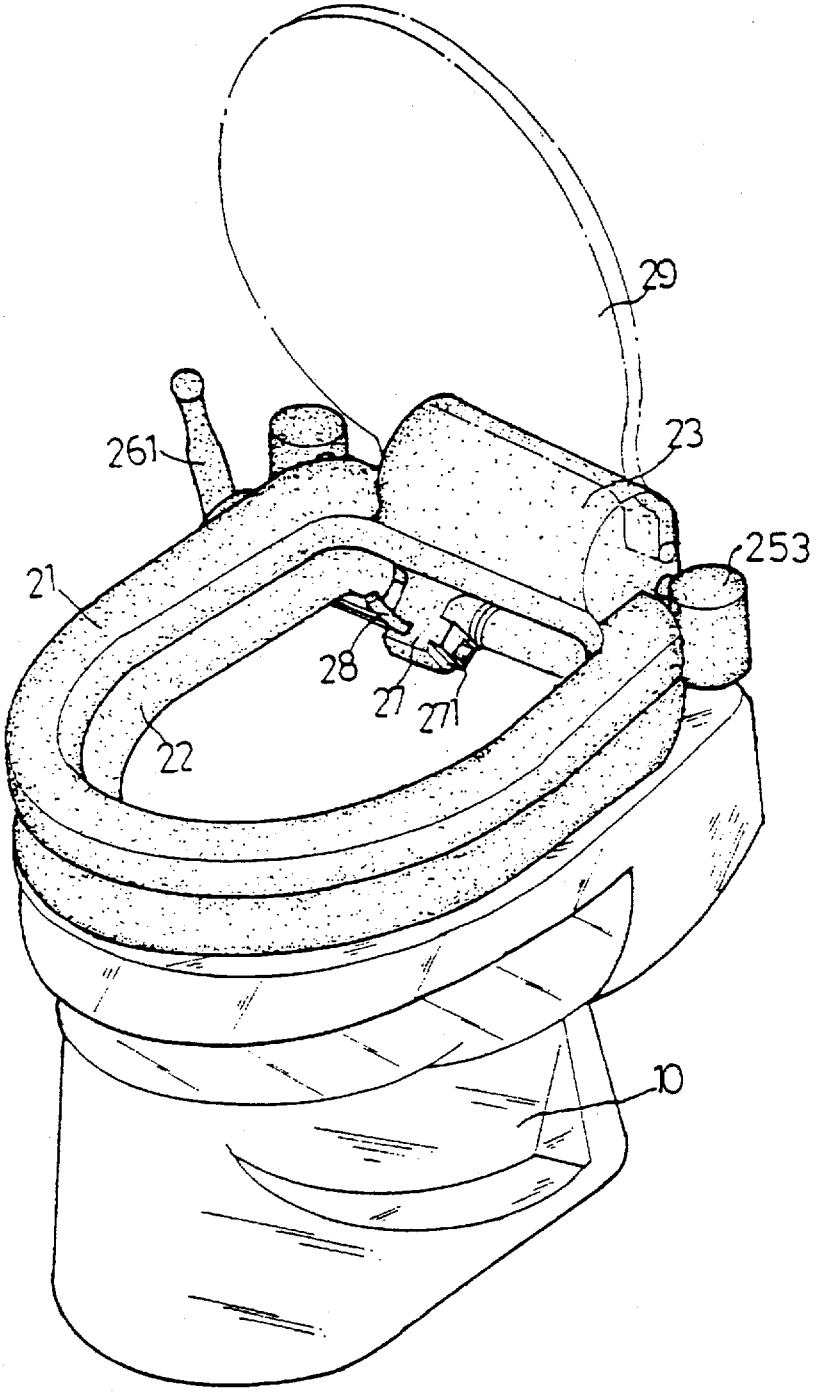
FIG. 1 is a perspective view of a flushing system disposed on a lavatory bowl in accordance with the present invention wherein a lavatory lid is shown in phantom lines.
Figure 2:
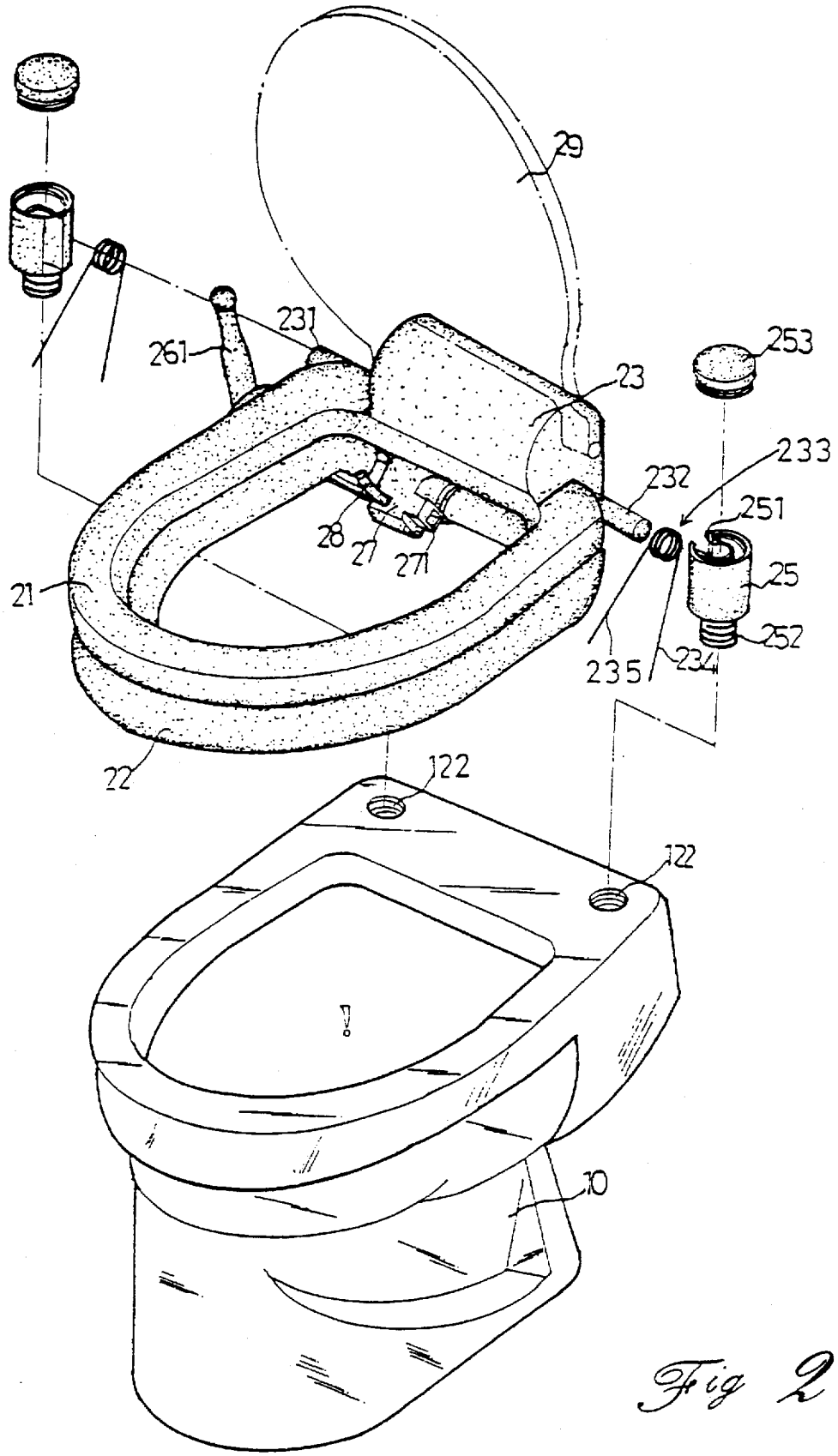
FIG. 2 is an exploded view of the flushing system and the lavatory bowl in accordance with the present invention.
Figure 3:
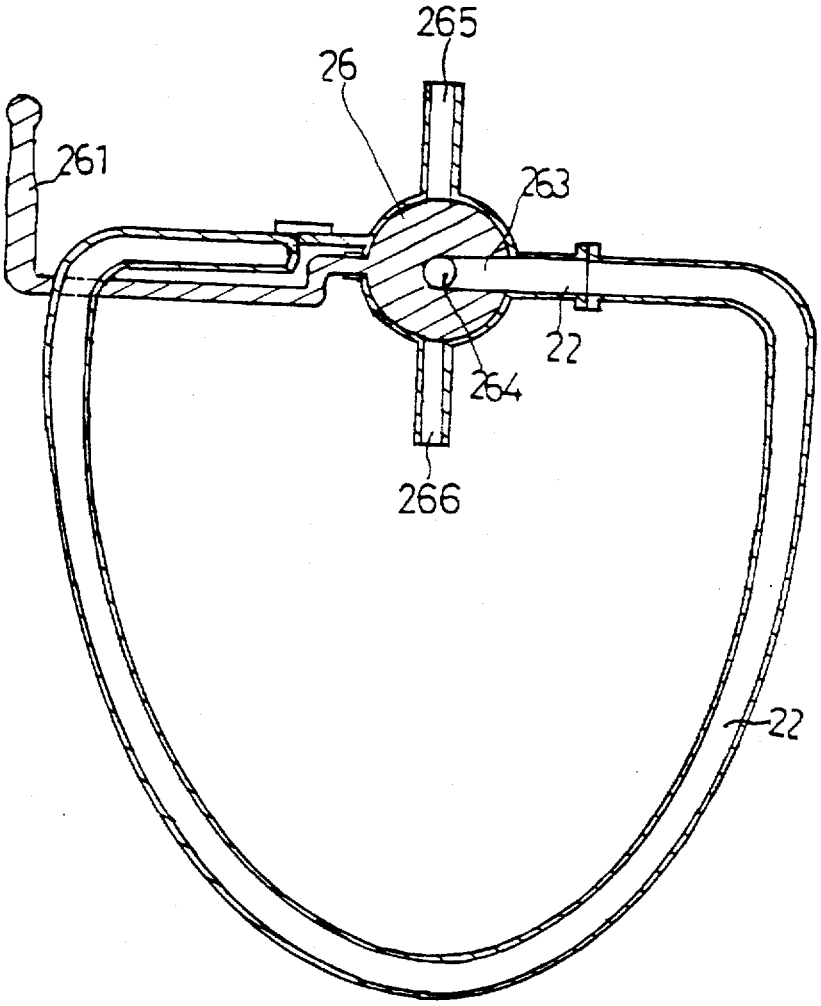
FIG. 3 is an illustrative view to show a valve means communicating with the a cistern of the flushing system.

Referring to the drawings and initially to FIGS. 1 through 3, a lavatory comprises a lavatory bowl 10 with a lavatory seat 21 pivotally disposed thereon, the lavatory bowl 10 having two threaded holes 122 defined in a rear end thereof. Two supports 25 each have a threaded portion 252 extending therefrom so as to be threadedly engaged with the corresponding threaded hole 122 of the lavatory bowl 10. Each of the supports 25 has a recess 251 defined laterally therein and a cap 253 disposed on a top of each of the supports 25. The flushing system in accordance with the present invention generally includes a first cistern 22 which is a flexible and an annular member and is disposed between the lavatory seat 21 and an upper portion of the lavatory bowl 10.

A block member 27 is disposed in communication with the first cistern 22 and has an exit 271 defined laterally therein and a tube 28 extending therefrom. The tube 28 extends upwardly inclined manner from the block member 27 and the exit 271 extends in a downwardly and inclined manner from the block member 27.

Figure 5:
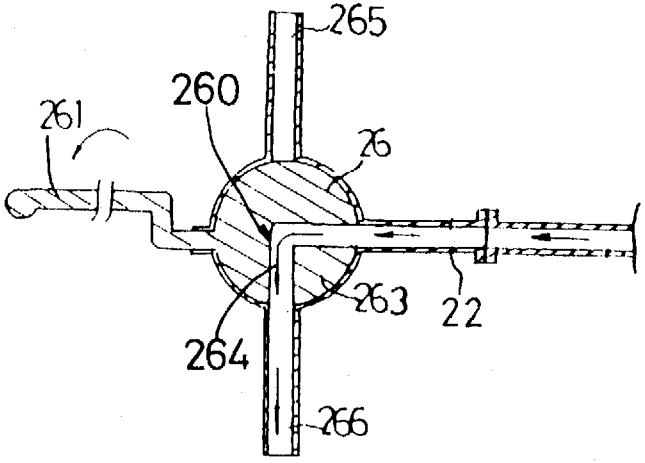
FIG. 5 is an illustrative view to show the valve means is rotated to communicate the L-shaped path thereof with an exit of the flushing system.
Figure 4:
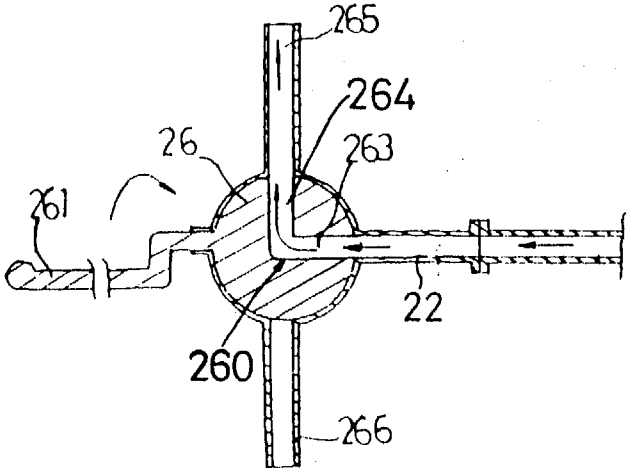
FIG. 4 is an illustrative view to show the valve means is rotated to communicate an L-shaped path thereof with a tube of the flushing system.

Further referring to FIGS. 4 and 5, a valve means 26 is rotatably connected to the first cistern 22 and has an L-shaped path 260 defined therein which comprises a first section 263 and a second section 264. The first section 263 of the L-shaped path 260 communicates with the first cistern 22 and the second section 264 of the L-shaped path 260 is adjustably and selectably communicated with a first pipe 265 which communicates with the tube 28 and a second pipe 266 which communicates with the exit 271 and by rotating the valve means 26. FIG. 3 shows the second section 264 is located at a close position where water neither flows from the tube 28 nor the exit 271. A crank 261 extends from the valve means 26 such that the valve means 26 is rotated by a user (not shown) by operating the crank 261.

A second cistern 23 is disposed above and in communication with the first cistern 22 on the rear end of the lavatory bowl 10 and a lavatory lid 29 is pivotally disposed to the second cistern 23. The second cistern 23 communicates with a main pipe so as to supply water into the second cistern 23.

Figure 6:
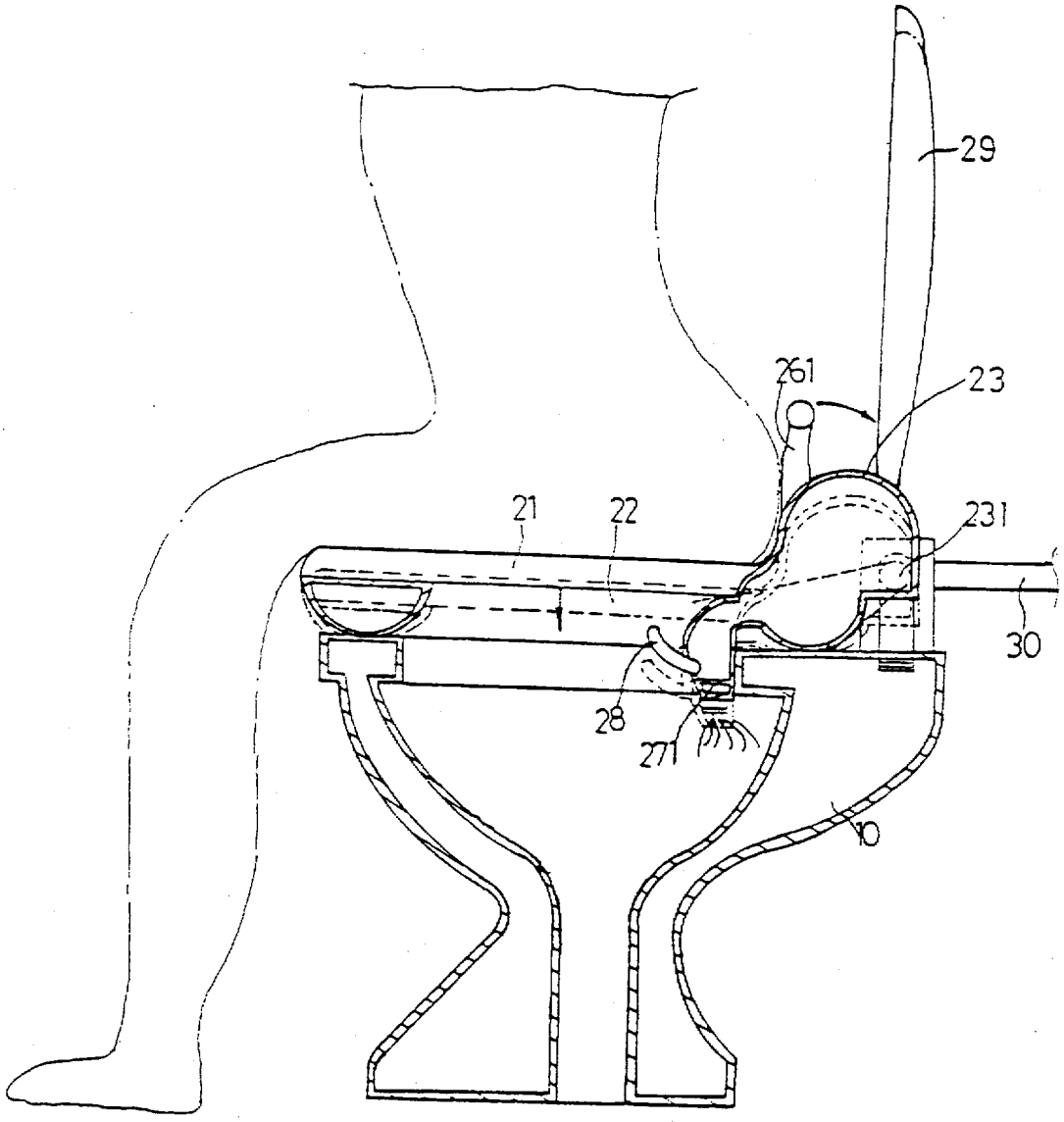
FIG. 6 is a top plan view to show water flows from the exit to flush the lavatory bowl.
Figure 7:
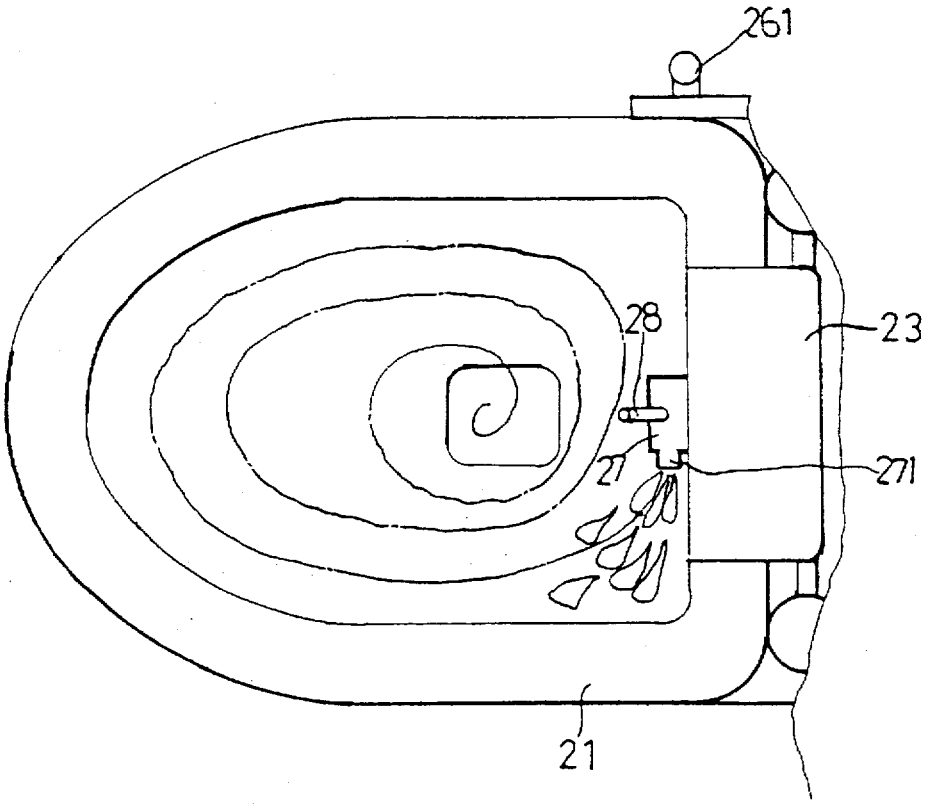
FIG. 7 is a side elevational view to show a user (shown in phantom lines) sat on the lavatory seat to depress the first cistern of the flushing system in accordance with the present invention.

When the crank 261 is rotated to rotate the valve means 26 to let the second section 264 of the L-shaped path 260 communicate with the first pipe 265 as shown in FIG. 4, water in the first cistern 22 is pressed by a weight of a user sitting on the lavatory seat 21 to eject from the tube 28 via the first pipe 265 so as to clean the bottom of the user. When the crank 261 is rotated to rotate the valve means 26 to let the first section 263 of the L-shaped path 260 communicate with the second pipe 266 as shown in FIG. 5, water in the first cistern 22 is pressed by a weight of a user (see FIG. 7) sitting on the lavatory seat 21 and to eject from the exit 271 via the second pipe 266 (see FIG. 6) so as to flush the lavatory bowl 10 wherein water in the second cistern 23 is supplied into the first cistern 22 continuously.

The second cistern 23 has two axles 231, 232 respectively extending laterally from two sides thereof so as to be inserted into the recess 251 of the corresponding support 25 with a spring 233 mounted on each of the axles 231, 232. The spring 233 has one end 234 disposed against the lavatory bowl 10 and the other end 235 disposed against a bottom of the first cistern 22 such that when the user stands up, the first cistern 22 and the lavatory seat 21 are pivoted upwardly.

Accordingly, the present invention provides a flushing system utilize the user's weight to press water in the first cistern 22 to eject from the tube 28 or the exit 271 by operating the valve means 26.

Although the invention has been explained in relation to its preferred embodiment, it is to be understood that many other possible modifications and variations can be made without departing from the spirit and scope of the invention as hereinafter claimed.

What is claimed is:

1. A flushing system for a lavatory which comprises a lavatory bowl with a lavatory seat disposed thereon, said flushing system comprising:

a first cistern which is a flexible and annular member for receiving water therein, said first cistern being disposed between said lavatory seat and said lavatory bowl such that when the weight of a user is applied to said flexible and annular member water therein is forced to valve a means;

a block member attached to and being in fluid communication with said first cistern, said block member having an exit defined laterally therein and a tube extending therefrom;

said valve means being rotatably connected to said first cistern and having an L-shaped path defined therein which comprises a first section and a second section, said first section of said L-shaped path communicating with said first cistern and said second section of said L-shaped path adjustably and selectively alternatively communicating with said tube and said exit by operating said valve means by a crank extending from said valve means, and a second cistern disposed above and in communication with said first cistern.

2. The flushing system as claimed in claim 1 wherein said tube extends in an upwardly inclined manner from said block member.

3. The flushing system as claimed in claim 1 wherein said exit extends in a downwardly and inclined manner from said block member.

* * * * *